US011097265B2

(12) United States Patent
Schroer et al.

(10) Patent No.: US 11,097,265 B2
(45) Date of Patent: Aug. 24, 2021

(54) MANUAL METERING DEVICE AND MANUAL METERING DEVICE ARRANGEMENT

(71) Applicant: IKA-Werke GmbH & Co. KG, Staufen (DE)

(72) Inventors: Erhard Schroer, Ulm (DE); Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 190 days.

(21) Appl. No.: 16/349,665

(22) PCT Filed: Nov. 10, 2017

(86) PCT No.: PCT/EP2017/001306
§ 371 (c)(1),
(2) Date: May 14, 2019

(87) PCT Pub. No.: WO2018/086741
PCT Pub. Date: May 17, 2018

(65) Prior Publication Data

US 2019/0329237 A1 Oct. 31, 2019

(30) Foreign Application Priority Data

Nov. 14, 2016 (DE) ..... 10 2016 121 817.0

(51) Int. Cl.
*B01L 3/02* (2006.01)

(52) U.S. Cl.
CPC ..... *B01L 3/021* (2013.01); *B01L 3/0286* (2013.01); *B01L 2200/023* (2013.01); *B01L 2200/028* (2013.01); *B01L 2200/087* (2013.01)

(58) Field of Classification Search
None
See application file for complete search history.

(56) References Cited

U.S. PATENT DOCUMENTS 6,240,791 B1 * 6/2001 Kenney ..... B01L 3/021 73/864.14
6,734,026 B1 * 5/2004 Kenney ..... B01L 3/021 422/504
2002/0012613 A1 * 1/2002 Scordato ..... B01L 3/0286 422/561

(Continued)

FOREIGN PATENT DOCUMENTS

EP 2452753 A2 5/2012
WO 2014178101 A1 11/2014

OTHER PUBLICATIONS

International Search Report from PCT Application No. PCT/EP2017/001306, dated Feb. 1, 2018.

*Primary Examiner* — Matthew D Krcha
*Assistant Examiner* — Brittany I Fisher
(74) *Attorney, Agent, or Firm* — Budzyn IP Law, LLC

(57) ABSTRACT

In order to be able to adapt a manual dosing device (1), in particular a pipette (2), to differently sized hand dimensions, the manual dosing device (1) at whose main body (3) at least one grip (5) or exchangeable grip is releasable, fastenable or fastened is proposed. Adaptation of the manual dosing device (1) to users having different hand sizes can be performed by removing the grip (5) or by changing the grip (5) and replacing the grip (5) with a grip (5) having different dimensions (FIG. 1).

17 Claims, 1 Drawing Sheet

(56) References Cited

U.S. PATENT DOCUMENTS

| | | | | |
|---|---|---|---|---|
| 2009/0117009 | A1 | 5/2009 | Cote | |
| 2012/0201722 | A1* | 8/2012 | Telimaa | B01L 3/0217 422/501 |
| 2016/0199830 | A1* | 7/2016 | LaCroix | B01L 3/0217 73/864.13 |

* cited by examiner

MANUAL METERING DEVICE AND MANUAL METERING DEVICE ARRANGEMENT

FIELD OF THE INVENTION

The invention relates to a manual dosing device, in particular a pipette, having a main body and having a fluid-dispensing unit which is connected to the main body. The invention also relates to a manual dosing device arrangement comprising at least one such manual dosing device.

BACKGROUND OF THE INVENTION

Such manual dosing devices are already from the prior art, in particular in the form of pipettes.

Such manual dosing devices are used by very different persons. With regard to their ergonomics, the known manual dosing devices are generally matched to persons having an average hand size and therefore provide ergonomic and comfortable handling for such persons. For persons with smaller hands or for persons with larger hands, ergonomic gripping and thus ergonomic handling of said manual dosing devices can be impaired. In particular frequent or prolonged use of the manual dosing device can therefore be uncomfortable and tiring for such persons.

SUMMARY OF THE INVENTION

It is therefore an object of the invention to provide a manual dosing device, and a manual dosing device arrangement, of the type mentioned in the introduction which allow adaptation to differently sized hands in a simple manner.

Said object is achieved with a manual dosing device of the type mentioned in the introduction by the means and features of the independent claim directed toward a manual dosing device. In particular, for achieving said object with a manual dosing device of the type mentioned in the introduction, it is proposed that the manual dosing device have a grip which is releasably fastened to the main body and is removable therefrom and/or is exchangeable. Thus, according to the invention, the grip is removable from the main body. In this way, the grip can, as required, be removed in a simple manner from the main body, and if appropriate be replaced by a differently formed, for example a smaller or larger, grip for the purpose of adapting the manual dosing device to a person with a smaller or larger hand size.

The grip can therefore be easily removed from the main body without great effort and without the use of tools. In this way, provision is made for a manual dosing device which, owing to the removable grip, can be adapted in a particularly simple and comfortable manner to at least two different hand sizes. The grip fastened to the main body leads to an increase in the cross section of the main body, and for this reason the main body and thus the manual dosing device can in this case be gripped and operated comfortably by a person with a relatively large hand. If the grip is removed, the cross section of the main body can be reduced and the manual dosing device can thus be adapted to the size of a relatively small hand.

It may be advantageous for the grip to be in the form of an exchangeable grip. Such a grip can then be replaced by another grip, which is matched to another hand size and can likewise be fastened to the main body.

As is stated further below in relation to a manual dosing device arrangement, it is also possible for the manual dosing device to be assigned at least two differently sized grips, which permit an ergonomically favorable adaptation of the manual dosing device to at least two different hand sizes.

It may be advantageous if, at the main body, for the releasable fastening of the grip, at least one fastening element which is matched to the grip is formed on an outer side of the main body and at least one matching mating fastening element is formed on a mating side of the grip, which mating side faces the main body. The at least one fastening element may for example be in the form of a fastening strip, in the form of a fastening knob, in the form of a fastening projection, or else in the form of a fastening depression—or fastening receptacle—into which a corresponding mating projection is insertable. In the case of a fastening knob being used as a fastening element, said fastening knob may preferably be head-shaped or mushroom head-shaped, in order to permit corresponding locking into a mating depression or mating receptacle on the grip.

The at least one mating fastening element may, in a manner matching the fastening element on the main body of the manual dosing device, be in the form of a strip receptacle, mating depression or mating receptacle, or else in the form of a mating knob. In the case of a mating depression or mating receptacle being used as a mating fastening element, said mating depression or mating receptacle may be formed such that a fastening element in the form of a fastening knob can be pressed into it for the purpose of fastening the grip to the main body of the manual dosing device. A force-fitting, a form-fitting or a force/form-fitting connection or even a locking connection can be formed here between the main body and the grip according to the design of the fastening knob and the mating depression or mating receptacle. The same applies with the use of a fastening depression or a fastening receptacle as a fastening element and a mating fastening element, formed in a matching manner, in the form of a mating knob.

However, it is also possible for the at least one fastening element and/or the at least one mating fastening element to be in the form of a magnetic fastening element. In this way, it is possible for example for a grip provided with a magnetic mating fastening element to be fixed to a main body which has a magnetically responsive fastening element or a housing composed of a magnetically responsive material. If the fastening element is a magnetic fastening element, a magnetically responsive grip or a grip having a magnetically responsive mating fastening element can likewise be releasably fastened to the main body in a reliable manner. It is thus possible to provide a fastening possibility which does not need any undercuts and thus helps to avoid dirt settling between the grip and the main body.

In one embodiment of the manual dosing device according to the invention of particular significance, a fastening element, for example the at least one fastening element already mentioned above, on the main body can also be matched to a holding device of an automatic manual dosing appliance, in particular of an automatic pipetting appliance. In this way, it is also possible to fix the manual dosing device according to the invention, with grip removed, to a corresponding holding device of a suitable automatic manual dosing appliance or automatic pipetting appliance in a reliable manner with the aid of the at least one fastening element, in order to make use of the otherwise manually actuable manual dosing device in an automated dosing or pipetting process too.

The manual dosing device can be particularly comfortable to handle if the main body has a rounded, round or circular cross section or even is cylindrical. The grip may have a grip shell which at least partially surrounds the main body in the position of use. In this way, the grip can be fixed to the main body in a particularly ergonomic manner. In this way, smooth transitions between the grip and the main body can be obtained, due to which the manual dosing device can be particularly comfortable to grip.

The grip may also be formed such that it surrounds the main body in an angular range of more than 180° in the position of use. In this way, the grip can be releasably fastened to the main body without separate fastening means. The grip formed in this manner can, in its position of use, then be slid axially onto the main body with respect to a longitudinal axis of the main body. If the housing has on its outer side a sliding stop for the grip, which sliding stop defines the position of use of the grip, the grip can be slid onto the main body into its position of use in a particularly reliable manner. Furthermore, it is possible that the grip is clamped to or onto the main body, that is to say has a clamping seat on the main body. It is thus possible to prevent the grip from slipping on the main body. This may be favorable in particular when the grip is to be slid axially onto the main body.

The grip may be of hook-shaped form at its upper end, which is adjacent to a head end of the main body. A grip formed to be hook-shaped in this manner allows the manual dosing device to be held particularly securely.

The manual dosing device may have an actuating element and/or a volume-adjusting means. Such an actuating element may for example be a pushbutton or pressing element, by way of which a mechanism, arranged in the main body, for actuating the fluid-dispensing unit can be activated. The volume-adjusting means may be a so-called volume-adjusting wheel, by way of which a volume to be dispensed, or to be pipetted, with the aid of the manual dosing device can be preset.

In this context, it may be particularly advantageous if the actuating element and/or the volume-adjusting means axially project beyond the grip in the position of use. In this way, it can be ensured that both the actuating means and the volume-adjusting means are easily accessible for a user even with the grip in the position of use, that is to say use of the manual dosing device is not adversely affected even with the grip fastened to the main body.

In a further embodiment of the manual dosing device according to the invention, it may be provided that the fluid-dispensing unit is releasably connected to the main body. For the purpose of releasably connecting to the main body the fluid-dispensing unit, the latter may be screwed to the main body.

It may be advantageous for the grip and the main body to be thermally decoupled from one another. For this purpose, it may be provided that an air gap is formed between an outer side, facing the grip, of the main body and the grip. Such a thermal decoupling allows an undesired introduction of heat, which can be transferred from a hand to the grip when the pipette is being held, from the grip to the main body to be largely avoided. The aim of this is to keep the accuracy of the manual dosing device as constant as possible.

If a particular person is to use the manual dosing device frequently over an extensive period of time, it may be advantageous for the manual dosing device to be matched to this specific user. For this purpose, the grip may be shaped in an ergonomic manner and so as to be matched to the requirements of the user. In order to achieve this, the grip may be produced in a manner matched to a previously measured hand shape of the user. This is possible with relatively little effort if the grip is produced by means of a rapid prototyping process, for example by means of a 3D printing process.

The aforementioned object is also achieved by a manual dosing device arrangement having the means and features of the independent claim directed toward the manual dosing device arrangement. Accordingly, to achieve the object, a manual dosing device arrangement comprising at least one manual dosing device as claimed in one of the preceding claims and at least two grips, which are matched to different hand sizes, is proposed, wherein the grips are releasably fastenable to a main body of the at least one manual dosing device.

BRIEF DESCRIPTION OF THE DRAWINGS

An exemplary embodiment of the invention is described in more detail below on the basis of the drawing. In the drawing, in part in a highly schematized illustration.

DETAILED DESCRIPTION OF THE INVENTION

Figure 1:
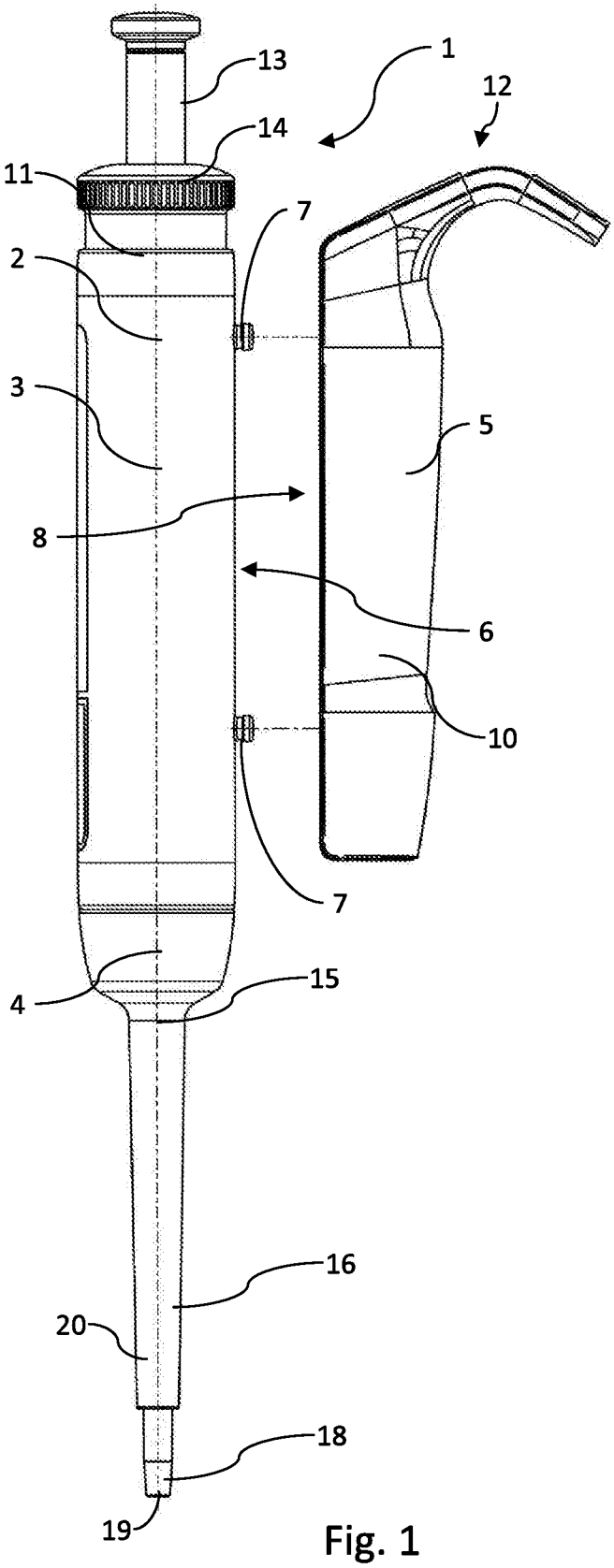
FIG. 1 shows a side view of a manual dosing device according to the invention, in the form of a manually actuable mechanical pipette, with a grip, which is removed from a main body of the manual dosing device, wherein two fastening elements in the form of fastening knobs can be seen on an outer side of the main body of the manual dosing device.
Figure 2:
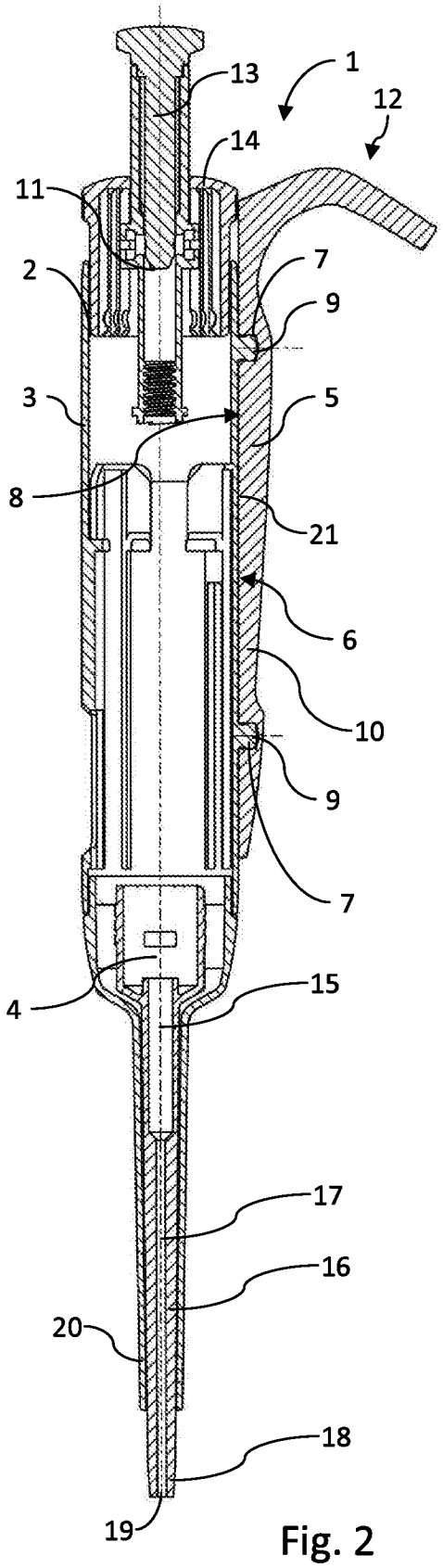
FIG. 2 shows a sectioned side view of the manual dosing device illustrated in FIG. 1 with the grip in its position of use, fastened to the outer side of the main body, wherein it can be seen that the two fastening elements engage into mating fastening elements, formed in a manner matching the fastening elements, in the form of two mating receptacles.

FIGS. 1 and 2 show a manual dosing device, denoted as a whole by 1, which is in the form of a manually actuable mechanical pipette 2 in the present case. The manual dosing device 1 comprises a main body 3 and a fluid-dispensing unit 4 which is connected to the main body 3. A grip 5 is provided on the main body 3 and is, as per FIG. 2, releasably fastened to the main body 3 and exchangeable. Consequently, the grip 5 may also be referred to as an exchangeable grip.

For the releasable fastening of the grip 5 to the main body 3, two fastening elements 7 which are matched to the grip 5 are formed on an outer side 6 of the main body 3. Formed on a mating side 8 of the grip 5, which mating side faces the main body 3 in the position of use of the grip 5, are mating fastening elements 9 which are formed in a manner matching the fastening elements 7.

In the exemplary embodiment of the manual dosing device according to the invention which is illustrated in FIGS. 1 and 2, the fastening elements 7 are fastening knobs, or fastening projections, which engage into the mating fastening elements 9, in the form of mating receptacles as per FIG. 2, on the mating side 8 of the grip 5.

At this juncture, it is worth noting that the two fastening elements 7 on the main body 3 are also matched to a holding device of an automatic manual dosing appliance or of an automatic pipetting appliance. This means that, with the grip 5 removed, the manual dosing device 1 can be fastened to a holding device of a manual dosing device or of an automatic pipetting appliance, with the result that the manual dosing device can also be used in an automatic operation.

Both figures show that the main body 3 and the manual dosing device 1 have, overall, a rounded, round and here even substantially circular cross section and are, at least sectionally, of cylindrical form. The grip 5 comprises a grip shell 10, with which said grip at least partially surrounds the main body 3 of the manual dosing device in the position of use as per FIG. 2.

Both figures show that the grip is of hook-shaped form at its upper end 12, which is adjacent to a head end 11 of the main body 3. The manual dosing device 1 has at its head end 11 an actuating element 13 and a volume-adjusting means 14 in the form of a volume-adjusting wheel. Both the actuating element 13 and the volume-adjusting means 14 axially project beyond the grip 5 in the position of use, with the result that both the actuating element 13 and the volume-adjusting means 14 can be comfortably reached by a user even with the grip 5 in the position of use.

The grip 5 and the main body 3 are thermally decoupled from one another. This allows a transfer of heat from the grip 5 to the main body 3, which could impair an accuracy of the manual dosing device 1, to be reduced or even avoided. For the purpose of the thermal decoupling, an air gap 21 is formed between the outer side 6, facing the grip 5, of the main body 3 and the grip 5.

The figures show that the grip 5 is ergonomically shaped and produced in a manner matched to a previously measured hand shape. This can occur by means of a rapid prototyping process.

Merely for the sake of completeness, it should be noted that the fluid-dispensing unit 4 is releasably connected to the main body 3. For this purpose, a screw, plug-in, snap and/or combined snap/screw connection may be provided between the fluid-dispensing unit 4 and the main body 3.

The manual dosing device 1 illustrated in FIGS. 1 and 2 forms, together with a further grip (not illustrated separately in the figures), a manual dosing device arrangement. The special feature here is that the at least two grips 5, which can be releasably fastened to the main body 3 of the manual dosing device and are interchangeable, have different dimensions and are thus matched to different hand sizes of different users. It is thus possible for the manual dosing device 1 to be adapted to different hand sizes without great effort by a simple change of the grips 5 assigned to the manual dosing device 1 according to the invention.

The fluid-dispensing unit 4 is in the form of a plunger unit and comprises a receiving chamber 15, for receiving an air cushion, and a shaft 16. The receiving chamber 15 is connected via a dispensing duct 17 formed in the shaft 16 to a dispensing opening 19 formed at a free end 18 of the shaft 16. Actuating the manual dosing device 1, that is to say pushing the actuating element 13, results in the air cushion in the receiving chamber 15 being displaced in the direction of the dispensing opening 19. In this way, a volume of liquid which is held in a pipette tip (not illustrated in the figures), which is fitted onto the free end 18 of the shaft 16, can be dispensed. When the air cushion is displaced in the reverse direction, a negative pressure is generated at the fitted-on pipette tip, with the aid of which negative pressure a defined volume of liquid, which depends on the preset volume of the air cushion, can be received in the pipette tip. The volume of the air cushion can be predefined by the volume-adjusting means 14.

The shaft 16 is surrounded by an ejector sleeve 20. By applying pressure axially to the volume-adjusting means 14, the ejector sleeve 20 can be displaced axially relative to the shaft 16 in the direction of the free end 18 of the shaft 16. The aim of this is to eject a pipette tip, fitted onto the free end 18 of the shaft 16, as required.

In order to be able to adapt a manual dosing device 1, in particular a pipette, to differently sized hand dimensions, the manual dosing device 1 at whose main body 3 at least one grip 5 or exchangeable grip is releasable, fastenable or fastened is proposed. Adaptation of the manual dosing device 1 to users having different hand sizes can be performed by removing the grip 5 or by changing the grip 5 and replacing the grip 5 with a grip 5 having different dimensions.

What is claimed is:

1. A manual dosing device (1), in particular pipette (2), having a main body (3) and having a fluid-dispensing unit (4) which is connected to the main body (3), the manual dosing device (1) having a grip (5) which is releasably fastened to the main body (3) of the manual dosing device (1) so as to be removable therefrom, wherein the grip (5) and the main body (3) are thermally decoupled from one another by an air gap (21) formed between an outer side (6) of the main body (3) and the grip (5), the outer side (6) of the main body (3) facing the grip (5).

2. The manual dosing device (1) as claimed in claim 1, wherein the grip (5) is in the form of an exchangeable grip, which is replaceable by another grip (5), the another grip (5) being matched to another hand size and being releasably fastenable to the main body (3).

3. The manual dosing device (1) as claimed in claim 1 wherein, for the releasable fastening of the grip (5), at least one fastening element (7), which is matched to the grip (5), is formed on the outer side (6) of the main body (3) and at least one matching mating fastening element (9) is formed on a mating side (8) of the grip (5), the mating side facing the main body (3).

4. The manual dosing device (1) as claimed in claim 3, wherein the at least one fastening element (7) is in the form of a fastening projection.

5. The manual dosing device (1) as claimed in claim 4, wherein the fastening projection is in the form of a mushroom head-shaped, fastening knob.

6. The manual dosing device (1) as claimed in claim 3, wherein the at least one matching mating fastening element (9) is one of: a strip receptacle, mating receptacle, and mating knob.

7. The manual dosing device (1) as claimed in claim 3, wherein the at least one fastening element (7) and the at least one matching mating element (9) are in the form of magnetic fastening elements.

8. The manual dosing device (1) as claimed in claim 1, wherein the grip (5) comprises a grip shell (10) which at least partially surrounds the main body (3) in the position of use.

9. The manual dosing device (1) as claimed in claim 1, wherein the grip (5) is formed such that the grip (5) surrounds the main body (3) in an angular range of more than 180° in the position of use and is able to be slid axially onto the main body (3) into the position of use.

10. The manual dosing device (1) as claimed in claim 9, wherein a sliding stop for the grip (5) is located on the main body (3).

11. The manual dosing device (1) as claimed in claim 1, wherein the grip (5) is of hook-shaped form at an upper end (12) thereof, which is adjacent to a head end (11) of the main body (3).

12. The manual dosing device (1) as claimed in claim 1, wherein the manual dosing device (1) has an actuating element (13) which axially projects beyond the grip (5) in the position of use.

13. The manual dosing device (1) as claimed in claim 1, wherein the fluid-dispensing unit (4) is releasably connected to the main body (3).

14. The manual dosing device (1) as claimed in claim 1, wherein the grip (5) is ergonomically shaped to match a previously measured hand shape.

15. A manual dosing device arrangement comprising at least one manual dosing device (1) as claimed in claim 1 and at least two grips (5), which are matched to different hand sizes and are fastenable in a reversibly releasable manner to a main body (3) of the at least one manual dosing device (1).

16. The manual dosing device (1) as claimed in claim 1, wherein the manual dosing device (1) has a volume-adjusting means which axially projects beyond the grip (5) in the position of use.

17. The manual dosing device (1) as claimed in claim 16, wherein the volume-adjusting means is a volume-adjusting wheel.

* * * * *